US007969379B2

(12) United States Patent
Knudsen et al.

(10) Patent No.: US 7,969,379 B2
(45) Date of Patent: Jun. 28, 2011

(54) BROADBAND VHF ANTENNA

(75) Inventors: Jon Knudsen, Roca, NE (US); Tony Meza, Lincoln, NE (US); Mark Mayer, Lincoln, NE (US); Abhinav Srivastava, Pittsburgh, PA (US)

(73) Assignee: Laird Technologies, Inc., Chesterfield, MO (US)

( * ) Notice: Subject to any disclaimer, the term of this patent is extended or adjusted under 35 U.S.C. 154(b) by 43 days.

(21) Appl. No.: 12/145,211

(22) Filed: Jun. 24, 2008

(65) Prior Publication Data

US 2009/0021445 A1 Jan. 22, 2009

Related U.S. Application Data

(60) Provisional application No. 60/947,882, filed on Jul. 3, 2007, provisional application No. 60/823,725, filed on Aug. 28, 2006.

(51) Int. Cl.
*H01Q 1/36* (2006.01)

(52) U.S. Cl. ..... 343/850; 353/895

(58) Field of Classification Search ..... 343/895, 343/702, 906, 715, 749, 850
See application file for complete search history.

(56) References Cited

U.S. PATENT DOCUMENTS

| | | | | | |
|---|---|---|---|---|---|
| 3,343,089 | A * | 9/1967 | Murphy et al. | ..... | 455/123 |
| 3,523,251 | A * | 8/1970 | Halstead | ..... | 455/282 |
| 3,795,005 | A * | 2/1974 | Monser et al. | ..... | 343/895 |
| 4,249,582 | A * | 2/1981 | Jacobs | ..... | 140/105 |
| 5,081,469 | A * | 1/1992 | Bones | ..... | 343/895 |
| 5,717,408 | A * | 2/1998 | Sullivan et al. | ..... | 343/702 |
| 5,828,341 | A * | 10/1998 | Delamater | ..... | 343/702 |
| 5,835,064 | A | 11/1998 | Gomez et al. | ..... | 343/702 |
| 5,894,292 | A * | 4/1999 | Everest et al. | ..... | 343/895 |
| 6,089,880 | A * | 7/2000 | Miyagawa et al. | ..... | 439/82 |
| 6,107,970 | A * | 8/2000 | Holshouser et al. | ..... | 343/702 |
| 6,232,925 | B1 * | 5/2001 | Fujikawa | ..... | 343/702 |
| 6,434,369 | B1 * | 8/2002 | Kanayama | ..... | 455/90.1 |

FOREIGN PATENT DOCUMENTS

WO WO 2005/119841 A2 12/2005

OTHER PUBLICATIONS

International Searching Authority Notification of TRansmittal of the International Search Report and the Written Opinion of the International Searching Authority, Oct. 22, 2008.*

International Searching Authority Notification of Transmittal of the International Search Report and the Written Opinion of the International Searching Authoirty, or the Declaration Oct. 22, 2008.

* cited by examiner

*Primary Examiner* — Michael C Wilmer

(74) *Attorney, Agent, or Firm* — Harness, Dickey & Pierce, P.L.C.

(57) ABSTRACT

An antenna assembly having a radiating element and a circuit board is provided. The radiating element is coupled to the circuit board by a conductive extension and hook portion where the hook portion extends into and possibly through a bore on the circuit board.

34 Claims, 4 Drawing Sheets

BROADBAND VHF ANTENNA

CROSS-REFERENCE TO RELATED APPLICATIONS

This application is related to U.S. Provisional Application 60/823,725, filed Aug. 28, 2006. This application claims the benefit of U.S. Provisional Application No. 60/947,882 filed Jul. 3, 2007.

STATEMENT REGARDING FEDERALLY SPONSORED RESEARCH

None.

FIELD OF THE INVENTION

The technology of the present application relates to antennas and, more particularly, to broadband VHF antennas.

BACKGROUND OF THE INVENTION

As wireless devices become more prevalent in our society, the users of such devices put increasing demands on wireless device providers to provide more functionality in smaller and smaller wireless devices without degrading reception or connectivity. Thus, although the space available in a wireless device for an antenna continually decreases, the performance needs of the antenna continually increase. Moreover, many wireless devices today require the ability to operate over multiple frequency ranges that frequently require the use of multiple antennas to cover the functionality of the device, exasperating the problem.

One useful antenna for wireless devices includes a helical antenna contained in a sheath. The helical antenna is a time tested antenna and does not require excessive volume internal to the wireless device as the bulk of the unit resides external to a housing of the wireless device. Moreover, multiple frequencies can be accommodated by varying the windings of the helical antenna, such as, for example, the pitch of the antenna.

Radio frequency power can be supplied to the helical antenna using any number of conventional feed mechanisms commonly known in the art. Often, the power supplied to the radiating element requires an impedance matching network to be implemented between the radio frequency power source and the radiating element itself.

To accommodate the need for an impedance matching network, some external antennas, including helical antennas, include an impedance matching network. For example, international publication number WO 2005/119841, published Dec. 15, 2005, by applicant Radiall Antenna Technologies, Inc. provides a circuit component in the antenna connector portion of the antenna assembly. Similarly, U.S. Pat. No. 5,835,064, issued Nov. 10, 1998, by Gomez et al., provides a circuit board in the antenna assembly. As one of ordinary skill in the art would appreciate on reading those disclosures, the circuit component and/or board provides, among, other things, an impedance matching function.

One difficulty with providing the printed circuit board in the antenna revolves around the mechanical connection of the radiator to the printed circuit board. Thus, against this background, it would be desirous to provide an improved connection between the radiating elements and the circuit board.

SUMMARY OF THE INVENTION

The technology of the present application provides an antenna assembly. The antenna assembly includes a circuit board and radiator where the circuit board has a power connection to couple to a radio frequency power supply. The radiator is coupled to the circuit board with a conductive path contained on the circuit board to connect the power connection to the radiator. The radiator is connected to the circuit board by a radiator connection. The radiator connection includes a hole contained in the circuit board and a hook extending into the hole. The hook is coupled to the conductive path. The hook is connected to a conductive extension that couples the hook and the radiator.

The foregoing and other features, utilities and advantages of the invention will be apparent from the following more particular description of a preferred embodiment of the invention as illustrated in the accompanying drawings.

BRIEF DESCRIPTION OF THE DRAWINGS

The accompanying drawings, which are incorporated in and constitute a part of this specification, illustrate embodiments of the present invention, and together with the description, serve; to explain the principles thereof. Like items in the drawings are referred to using the same numerical reference.

DETAILED DESCRIPTION

The technology of the present application will now be described with reference to the figures. While described in connection with a two-way radio, one of ordinary skill in the art will understand on reading the disclosure that the technology of the present application may be used in conjunction with many wireless devices, such as, for example, cellular telephones, PDAs, wireless computers, handheld computers, MP3 players, electronic games, portable televisions, or the like. Moreover, the antenna is generally described as a conventional helical antenna, but one of ordinary skill in the art would recognize on reading the disclosure that the technology of the present application could be implemented with other types of antenna designs.

Figure 1:
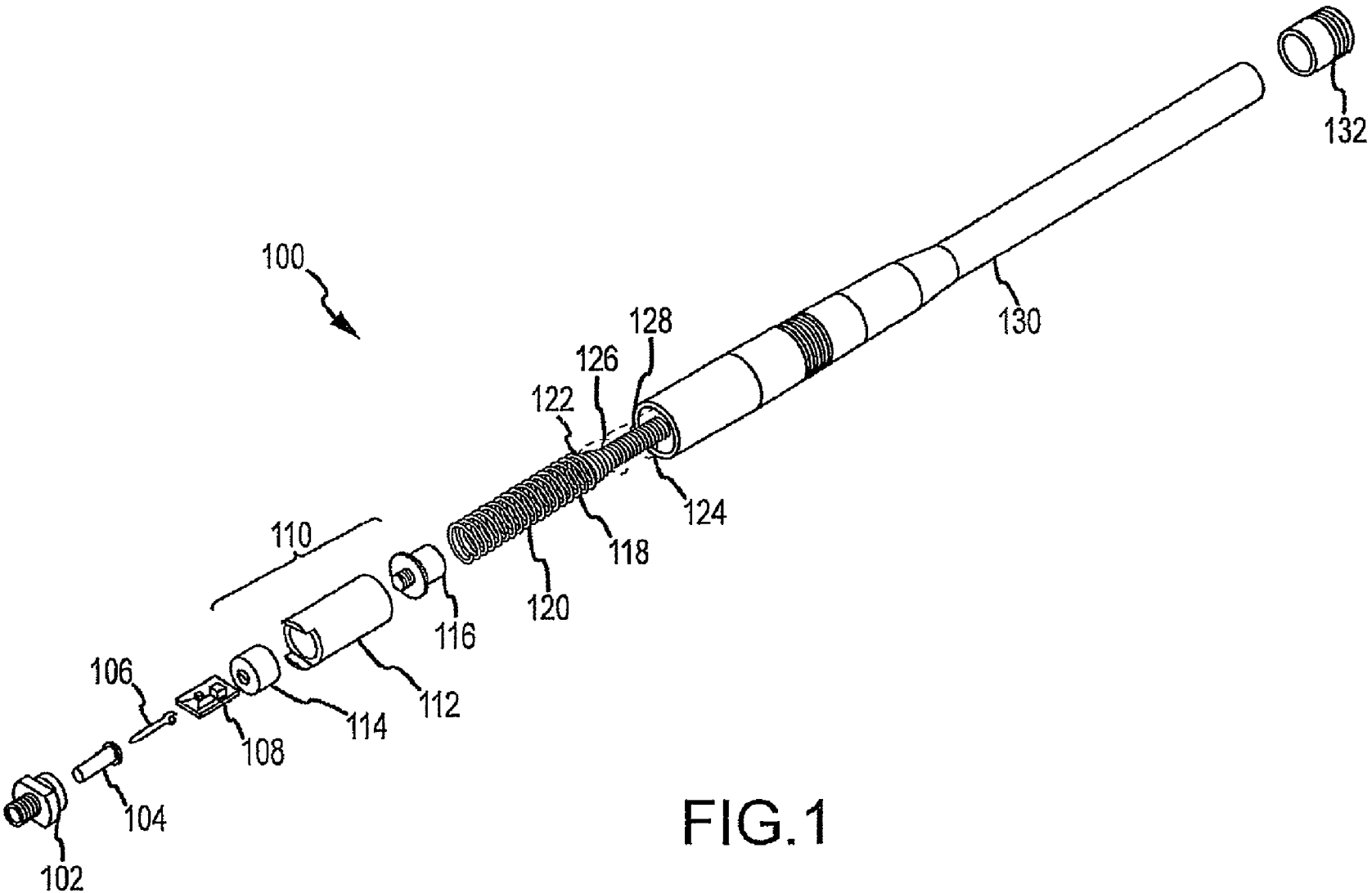
FIG. 1 is an exploded perspective view of an exemplary embodiment of an antenna.

Referring first to FIG. 1, a partially exploded antenna 100 is shown. Antenna 100 includes a connector 102 to connect the antenna 100 to the housing of a two-way radio or the like, not specifically shown, but generally understood in the art. Connector 102 is shown as a threaded connection but could be a snap fit connection or the like. An insulator 104 resides in the connector electrically insulating a contact 106 from connector 102. Contact 106 is connected to a circuit board 108. Circuit board 108 is attached to an adapter 110, which is contained in a sleeve 112. RF Power from the wireless device, such as the two-way radio is provided to antenna 100 by contact 106 through circuit board 108 as is further explained below.

Adapter 110 comprises a circuit board connection portion 114 and a coil connection portion 116 coupled together by a pressed fit, snap fit, friction fit or the like. A gap G (best seen in FIG. 3) resides between coil connection portion 116 and a sheath 130 to allow a coil 118 to be placed in gap G between coil connection portion 116 and sheath 130. As shown, coil 118 has a wider diameter base 120 to provide increase bandwidth of operation. Coil 118 is shown with a tapered section 122 reducing the diameter and pitch of the coils to a narrow diameter top 124. Instead of a tapered section 122 and a narrow diameter top 124, coil 118 could be a constant width from base to top. Moreover, tapered section 122 could be replaced with a flared portion 126 and an even wider top portion 128 as shown in outline over coil 118.

Antenna 100 is provided with sheath 130 and end cap 132. Sheath 130 may be overmolded or constructed in any conventional manner. As can be appreciated, for space considerations, sheath 130 generally conforms to the shape of coil 118.

Figure 2:
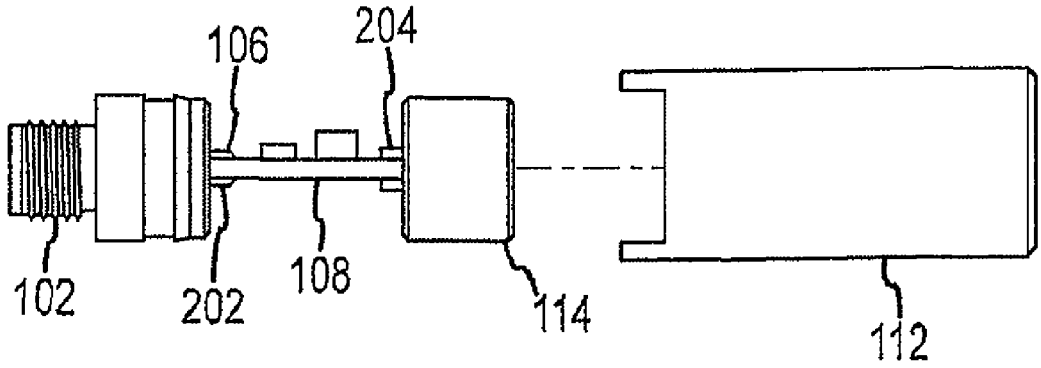
FIG. 2 is a partially exploded view of a circuit board of FIG. 1.
Figure 2A:
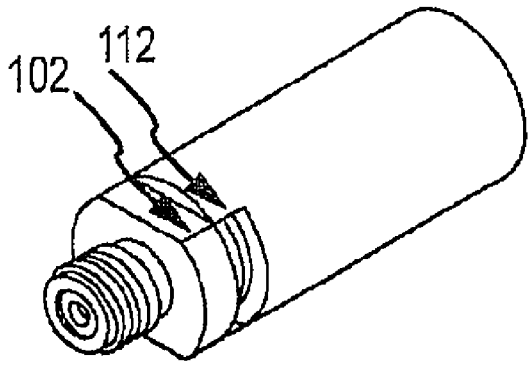
FIG. 2A shown a perspective view of FIG. 2.

Referring now to FIG. 2, connector 106 is coupled to circuit board 108 at connection point 202. Connection point 202 may be a soldered connection, a press fit connection, a snap fit connection, a crimp connection or the like. Similarly, circuit board 108 is connected to circuit board connection portion 114 at connection point 204. Connection point 204 may be a soldered connection, a press fit connection, a snap fit connection, a crimp connection or the like. Connection point 202 and connection point 204 are generally the same type of connection, for example, soldered connection, but may be different connections. Sleeve 112 fits over the circuit board 108 and extends from connector 102 to circuit board connection portion 114 as shown in FIG. 2A.

Figure 3:
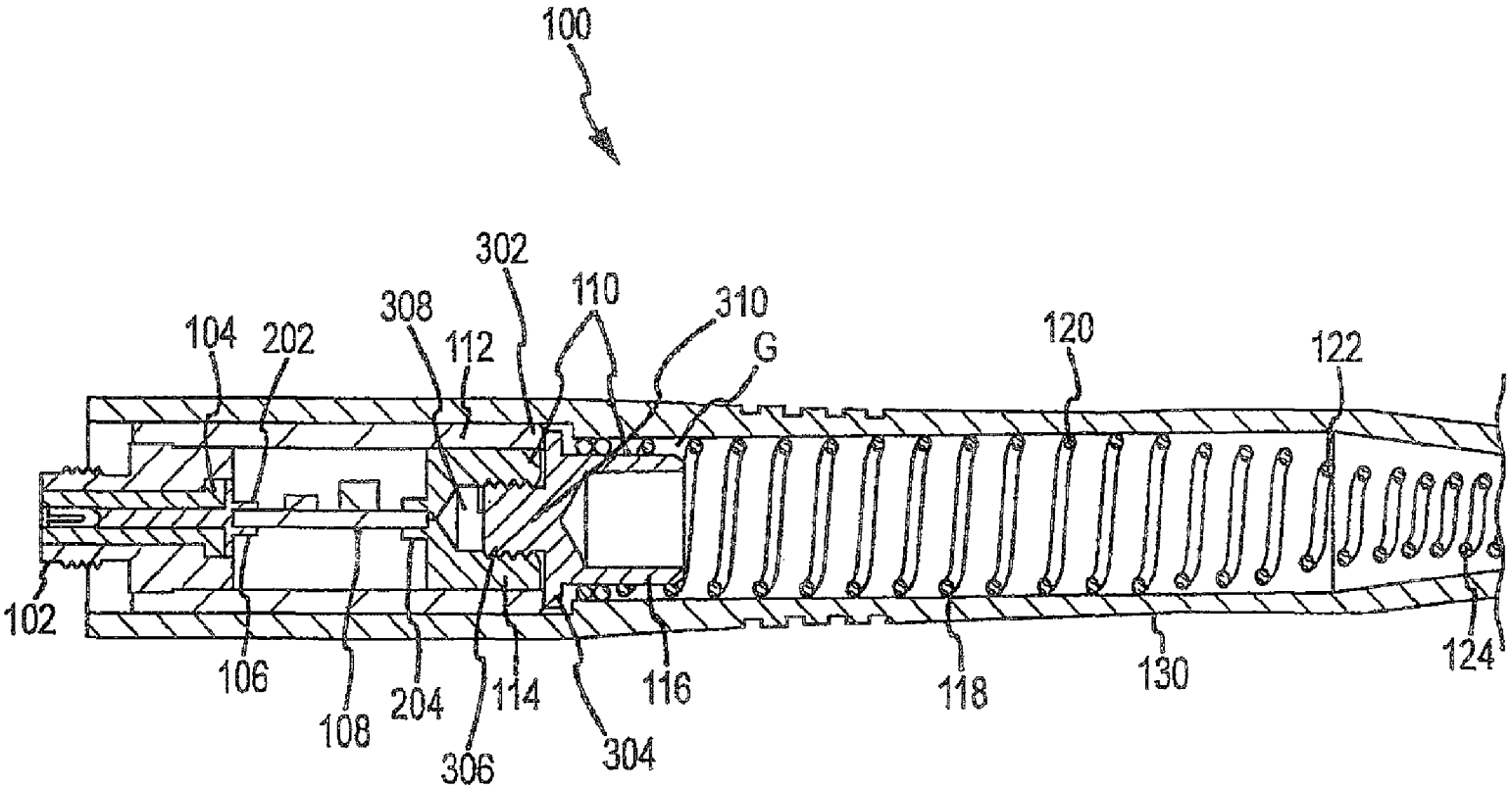
FIG. 3 is a cross-section of a portion of antenna 100.

The contact 106 provides RF power to coil 118 through circuit board 108 as best shown in FIG. 3. Circuit board 108 provides broadband impedance matching for coil 118. Conventionally, impedance matching generally provides a 50 ohm load across the operating frequency of interest. Placing circuit board 108 in antenna 100 provides more volume in the wireless device for increased circuitry to further enhance performance of the radio. Circuit board 108 may comprise, for example, a two-element L shaped network of a capacitor and shunt inductor for the 136 to 174 MHz range, but other elements and structures as are conventionally known in the art may be mounted on the antenna instead of in the housing of the wireless device. As can be seen best in FIG. 3, sleeve 112 may have shoulders 302 abutting a flanged surface 304 on the base of coil connection portion 116. Also, circuit board connection portion 114 and coil connection portion 116 of adapter 110 are coupled together by a coupling 306. Coupling 306 comprises a threaded bore 308 in circuit board connection portion 114 and a threaded protrusion 310 extending from flanged surface 304. However, threaded bore 308 and threaded protrusion 310 may be reversed and/or replaced by a friction fitting as desired.

Figure 4A:
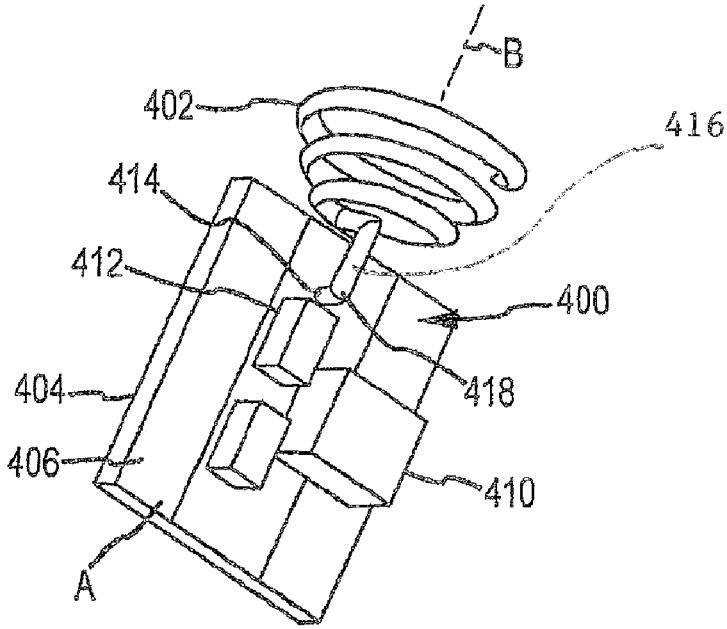
FIGS. 4A and 4B are an illustration of a connection between the radiator and the circuit board.
Figure 4B:
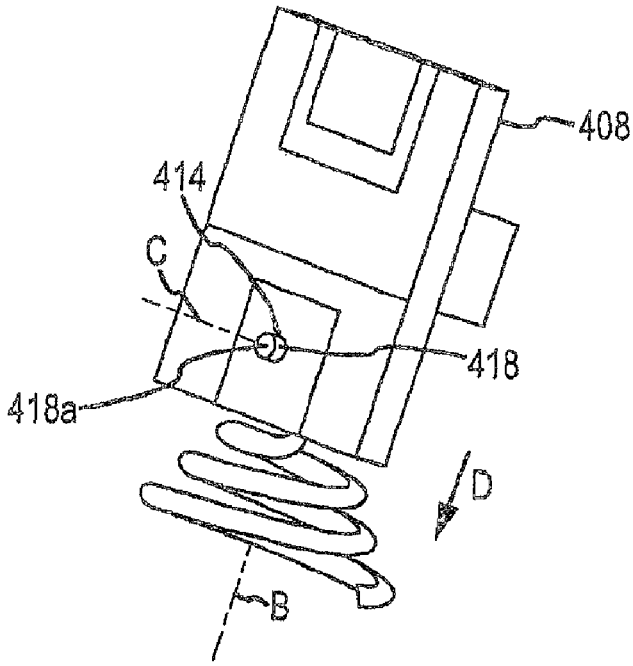

Referring now to FIGS. 4A and 4B, a connection 400 between a radiator 402 and circuit board 404 is provided. Radiator 402 is shown as a helical coil to be consistent with the technology described above, but could be other types of radiators as now would be appreciated by those of ordinary skill in the art. FIG. 4A shows a perspective view of a first side 406 of circuit board 404 and FIG. 4B shows a perspective view of a second side 408 of circuit board 404. As shown, circuit board 404 may have any conventional surface mount technology elements 410, such as, for example, capacitors, inductors, resistors, or the like, as well as conductive traces 412.

Connection 400 between circuit board 404 and radiator 402 may be formed by providing a conductive extension 416 from radiator 402 that terminates in a hook portion 418 that extends through a through hole 414 extending from first side 406 to second side 408 of circuit board 404. Conductive extension 416 and hook portion 418 may be referred to as a L-shaped hook or a J shaped hook. In some instances, hook portion 418 may terminate in a protrusion 418*a* to provide additional resistance to pull through force tending to cause hook portion 418 to pull out of through hole 414. The hook portion 418 would be sized to fit in and through through hole 414 to provide a mechanical connection between circuit board 404 and radiator 402. While described as a through hole or bore, hole 414 does not need to be circular, but could have any desired shape. Moreover, hook portion 418 would be similarly shaped. Also, hole 414 may be in the form of a detent or blind hole instead of a complete through hole. In that case, hook portion 418 would not extend through hole 414, but rather into hole 414. The bore of hole 414, which may be other than circular, may have a receiving recess to fit protrusion 418*a* in the case where the hole 414 does not penetrate through circuit board 404.

Circuit board 404 forms a plane A. Conductive extension 416 has a longitudinal axis B generally parallel to plane A. Notice, while conductive extension 416 is shown as a straight extension, conductive extension 416 could have a meandering pattern as a matter of design choice. Conductive extension 416 may converge or diverge from radiator 402 to hook portion 418. Such convergence of divergence will generally be due to manufacturing tolerances, but could be related to specific antenna design considerations. Hook portion 418 is shown having a longitudinal axis C. Longitudinal axis C is generally perpendicular to Plane A and longitudinal axis B. Hook portion 418 and conductive extension portion generally form a 90° angle to facilitate inserting hook portion 418 through through hole 414 as well as provide a resistance to the tendency of radiator 402, shown as a coil, to compress in direction D. While the 90° angle facilitates both features, any angle less than 180° is possible although an acute angle or right angle is preferred over an obtuse angle. Electrical connection is made by any conventional means to connect conductive traces 412 and hook portion 418. Such electrical connection may be a solder connection, a press fit connection, a stamped metal connection, or the like.

As shown in this case, radiator 402 is a coil radiator. Conductive extension 416 and hook portion 418 are shown as extensions of the coil. Radiator 402, conductive extension 416, and hook portion 418 need not be single unit, but multiple connected units as desired.

The previous description of the disclosed embodiment is provided to enable any person skilled in the art to make or use the technology of the present application. Various modifications to the embodiment will be readily apparent to those skilled in the art on reading the disclosure, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An external broadband VHF antenna assembly for a portable wireless device comprising:

a circuit board, the circuit board comprising a power connection to couple to a radio frequency power supply, and an impedance matching network on the circuit board;

a radiator coupled to the circuit board;

a conductive path contained on the circuit board connecting the power connection to the radiator;

a radiator connection coupling the radiator to the circuit board comprising:

a hole contained in the circuit board;

a hook portion extending into the hole to thereby provide a mechanical connection between the circuit board and the radiator, the hook portion coupled to the conductive path; and a conductive extension coupling the hook portion to the radiator;

wherein the impedance matching network is coupled between the power connection and the radiator connection;

whereby the circuit board, radiator, and radiator connection are external to a housing of a portable wireless device when the antenna assembly is connected to the portable wireless device.

2. The antenna assembly of claim 1, wherein the radiator is a helical radiator.

3. The antenna assembly of claim 2, wherein the helical radiator comprises a plurality of coil pitches.

4. The antenna assembly of claim 2, wherein the conductive extension is an extension of the helical radiator.

5. The antenna assembly of claim 4, wherein the hook portion is a single integral part with the conductive extension.

6. The antenna assembly of claim 1, wherein the circuit board defines a plane and the conductive extension has a longitudinal axis parallel to the plane.

7. The antenna assembly of claim 6, wherein the hook portion has a longitudinal axis perpendicular to the plane.

8. The antenna assembly of claim 1, wherein the hole is a through hole.

9. The antenna assembly of claim 8, wherein the hole has a longitudinal axis perpendicular to a plane defined by the circuit board.

10. The antenna assembly of claim 8, wherein the conductive extension has a longitudinal axis parallel to the plane and the hook portion has a longitudinal axis perpendicular to the plane.

11. The antenna assembly of claim 10, wherein the hook portion extends through the hole.

12. The antenna assembly of claim 6, wherein the hook has a longitudinal axis defining an acute angle with the longitudinal axis of the conductive extension.

13. The antenna assembly of claim 1, wherein the antenna assembly includes an adapter having a coil connection portion about which is positioned at least one coil of the radiator.

14. The antenna assembly of claim 13, wherein the hook portion and conductive extension are operable for mechanically and electrically connecting the adapter to the circuit board.

15. The antenna assembly of claim 14, wherein at least a portion of the adapter is contained within a tubular sleeve.

16. The antenna assembly of claim 1, wherein the hook portion is coupled to the conductive path by at least one of solder connection, a press fit connection, or a stamped metal connection.

17. The antenna assembly of claim 1, wherein the impedance matching network comprises a capacitor and an inductor, and wherein the impedance matching network is operable for providing broadband impedance matching for the radiator for the 136 to 174 MHz range.

18. A portable wireless device comprising a housing and the antenna assembly of claim 1, wherein the antenna assembly includes:

a sheath disposed over the circuit board, radiator, and radiator connection;

a connector connecting the antenna assembly to the housing of the portable wireless device, such that the sheath, circuit board, radiator, and radiator connection are external to the housing of the portable wireless device.

19. An external broadband VHF antenna assembly for a portable wireless device, comprising:

a circuit board, the circuit board comprising a power connection to couple to a radio frequency power supply, and an impedance matching network residing on the circuit board;

means for radiating coupled to the circuit board;

means for coupling the means for radiating to the circuit board, comprising:

a hole contained in the circuit board;

a hook portion extending into the hole to thereby provide a mechanical connection between the circuit board and the radiator;

means on the circuit board for coupling the power connection to the means for radiating;

wherein the impedance matching network is coupled between the power connection and the means for radiating;

whereby the circuit board and means for radiating are external to a housing of a portable wireless device when the antenna assembly is connected to the portable wireless device.

20. The antenna assembly of claim 19, wherein the means for radiating comprises a helical antenna.

21. The antenna assembly of claim 19, wherein the means for coupling the power connection to the means for radiating comprises at least one conductive trace.

22. The antenna assembly of claim 19, wherein the hook portion comprises a L shaped hook.

23. The antenna assembly of claim 19, wherein the hook portion comprises a J shaped hook.

24. The antenna assembly of claim 19, wherein the impedance matching network comprises a capacitor and an inductor, and wherein the impedance matching network is operable for providing broadband impedance matching for the radiator for the 136 to 174 MHz range.

25. A portable wireless device comprising a housing and the antenna assembly of claim 19, wherein the antenna assembly includes:

a sheath disposed over the circuit board and means for radiating;

a connector connecting the antenna assembly to the housing of the portable wireless device, such that the sheath, circuit board, and means for radiating are external to the housing of the portable wireless device.

26. An antenna assembly comprising:

a radiator including:

a conductive extension that terminates in a hook portion;

a helical coil radiator including a wider diameter base adjacent the conductive extension;

coils; and a tapered section reducing in diameter and pitch of the coils to a narrower diameter top;

a circuit board including:

a power connection to couple to a radio frequency power supply;

an electrically conductive path on the circuit board electrically connected to the power connection; and a hole in the circuit board;

wherein the hook portion extends into the hole to provide a mechanical connection between the circuit board and the radiator;

wherein the hook is electrically connected to the electrically conductive path on the circuit board to thereby provide an electrical connection between the power connection and the radiator.

27. The antenna assembly of claim 26, wherein the antenna assembly is configured to be operable such that radio frequency power is supplied to the radiator via the power connection when coupled to a radio frequency power supply and the electrically connection between the power connection and the radiator provided by the electrically conductive path and hook.

28. The antenna assembly of claim 26, wherein the radiator comprises a helical radiator formed of a single integral part that includes a plurality of coils, the conductive extension, and the hook portion.

29. The antenna assembly of claim 26, wherein:

the hole is a through hole that extends completely through the circuit board; and the hook portion comprises a J-shaped or L-shaped hook that terminates in a protrusion having a larger width than the hole, to inhibit the hook portion from being out of the through hole.

30. The antenna assembly of claim 26, wherein the antenna assembly includes an adapter having a coil connection portion about which is positioned at least one coil of the radiator.

31. The antenna assembly of claim 30, wherein the hook portion and conductive extension are operable for mechanically and electrically connecting the adapter to the circuit board.

32. The antenna assembly of claim 31, wherein at least a portion of the adapter is contained within a sleeve.

33. The antenna assembly of claim 26, wherein the hook portion is coupled to the conductive path by at least one of solder connection, a press fit connection, or a stamped metal connection.

34. The antenna assembly of claim 26, wherein the antenna assembly comprises a VHF broadband antenna assembly further comprising a capacitor and an inductor on the circuit board operable for providing broadband impedance matching for the radiator for the 136 to 174 MHz range.

* * * * *